US006088668A

United States Patent [19]

Zack

[11] Patent Number: 6,088,668

[45] Date of Patent: Jul. 11, 2000

[54] NOISE SUPPRESSOR HAVING WEIGHTED GAIN SMOOTHING

[75] Inventor: Rafael Zack, Givat Shmuel, Israel

[73] Assignee: D.S.P.C. Technologies Ltd., Givat Shmuel, Israel

[21] Appl. No.: 09/102,739

[22] Filed: Jun. 22, 1998

[51] Int. Cl.[7] ..... G10L 21/02

[52] U.S. Cl. ..... 704/225; 381/94.3; 704/226

[58] Field of Search ..... 704/225, 226, 704/227; 381/94.2, 94.3, 94.1; 375/232, 347

[56] References Cited

U.S. PATENT DOCUMENTS

| | | | |
|---|---|---|---|
| 4,628,529 | 12/1986 | Borth et al. | 381/94.3 |
| 4,630,305 | 12/1986 | Borth et al. | 381/94.3 |
| 4,811,404 | 3/1989 | Vilmur et al. | 381/94.3 |
| 5,012,519 | 4/1991 | Adlersberg et al. | 704/226 |
| 5,432,859 | 7/1995 | Yang et al. | 381/94.3 |
| 5,544,250 | 8/1996 | Urbanski | 381/94.3 |
| 5,550,924 | 8/1996 | Helf et al. | 381/94.3 |
| 5,659,622 | 8/1997 | Ashley | 704/227 |
| 5,666,429 | 9/1997 | Urbanski | 381/94.1 |
| 5,706,395 | 1/1998 | Arsian et al. | 704/226 |
| 5,844,951 | 12/1998 | Proakis et al. | 375/347 |

OTHER PUBLICATIONS

Tim Haulick, "Residual Noise Suppression Using Psychoacoustic Criteria", ESCA Eurospeech97, Rhodes, Greece, ISSN 1018–4074, pp. 1395–1398.

Pascal Scalart et al., "Speech Enhancement Based on a Priori Signal To Noise Estimation", 0–7803–3192–3/96, IEEE 1996, pp. 629–632.

Gary Whipple, "Low Residual Noise Speech Enhancement Utilizing Time–Frequency Filtering", Proceedings of the IEEE International Conference on Acoustics, Speech, and Signaling Processing, vol. 1, 1994, pp. 5–8.

M. Berouti et al., "Enhancement of Speech Corrupted By Acoustic Noise", Proceedings of the IEEE International Conference on Acoustics, Speech, and Signal Processing, pp. 208–211, Apr. 1979, pp. 69–73.

*Primary Examiner*—David R. Hudspeth
*Assistant Examiner*—Martin Lerner
*Attorney, Agent, or Firm*—Skjerven, Morrill, MacPherson, Franklin & Friel LLP

[57] ABSTRACT

A noise suppressor is provided which includes a signal to noise ration (SNR) determiner, a channel gain determiner, a gain smoother and a multiplier. The SNR determiner determines the SNR per channel of the input signal. The channel gain determiner determines a channel gain $\gamma_{ch}(i)$ per the ith channel. The gain smoother produces a smoothed gain $\overline{\gamma_{ch}(i,m)}$ per the ith channel and the multiplier multiplies each channel of the input signal by its associated smoothed gain $\overline{\gamma_{ch}(i,m)}$.

5 Claims, 4 Drawing Sheets

NOISE SUPPRESSOR HAVING WEIGHTED GAIN SMOOTHING

FIELD OF THE INVENTION

The present invention relates generally to methods of noise suppression using acoustic spectral subtraction.

BACKGROUND OF THE INVENTION

Acoustic noise suppression in a speech communication system generally serves the purpose of improving the overall quality of the desired audio or speech signal by filtering environmental background noise from the desired speech signal. This speech enhancement process is particularly necessary in environments having abnormally high level of background noise.

Reference is now made to FIG. 1 which illustrates one noise suppressor which uses spectral subtraction (or spectral gain modification). The noise suppressor includes frequency and time domain converters 10 and 12, respectively, and a noise attenuator 14.

The frequency domain converter 10 includes a bank of bandpass filters which divide the audio input signal into individual spectral bands. The noise attenuator 14 attenuates particular spectral bands according to their noise energy content. To do so, the attenuator 14 includes an estimator 16 and a channel gain determiner 18. Estimator 16 estimates the background noise and signal power spectral densities (PSDs) to generate a signal to noise ratio (SNR) of the speech in each channel. The channel gain determiner 18 uses the SNR to compute a gain factor for each individual channel and to attenuate each spectral band. The attenuation is performed by multiplying, via a multiplier 20, the signal of each channel by its gain factor. The channels are recombined and converted back to the time domain by converter 12, thereby producing a noise suppressed signal.

For example, in the article by M. Berouti, R. Schwartz, and J. Makhoul, "Enhancement of Speech Corrupted by Acoustic Noise", *Proceedings of the IEEE International Conference on Acoustic Speech Signal Processing,* pp. 208–211, April 1979, which is incorporated herein by reference, the method of linear spectral subtraction is discussed. In this method, the channel gain $\gamma_{ch}(i)$ is determined by subtracting the noise power spectrum from the noisy signal power spectrum. In addition, a spectral floor $\beta$ is used to prevent the gain from descending below a lower bound, $\beta|E_n(i)|$.

The gain is determined as follows:

$$\gamma_{ch}(i) = \frac{|D(i)|}{|E_{ch}(i)|}$$

where:

$$D(i) = \begin{cases} |E_{ch}(i)| - |E_n(i)| \text{ if } |E_{ch}(i)| - |E_n(i)| \geq \beta|E_n(i)| \\ \beta|E_{ch}(i)| \end{cases}$$

$|E_{ch}(i)|$ is the smoothed estimate of the magnitude of the corrupted speech in the ith channel and $|E_n(i)|$ is the smoothed estimate of the magnitude of the noise in the ith channel.

FIG. 2 illustrates the channel gain function $\gamma_{ch}(i)$ per channel SNR ratio and indicates that the channel gain has a short floor 21 after which the channel gain increases monotonically.

Unfortunately, the noise suppression can cause residual 'musical' noise produced when isolated spectral peaks exceed the noise estimate for a very low SNR input signal.

FIGS. 3A and 3B, to which reference is now made, illustrate the typical channel energy in an input signal and the linear spectral subtraction, gain signal, over time. The energy signal of FIG. 3A shows high energy speech peaks 22 between which are sections of noise 23. The gain function of FIG. 3B has accentuated areas 24, corresponding to the peaks 22, and significant fluctuations 25 between them, corresponding to the sections of noise in the original energy signal. The gains in the accentuated areas 24 cause the high energy speech of the peaks 22 to be heard clearly. However, the gain in the fluctuations 25, which are of the same general strength as the gain in the accentuated areas 24, cause the musical noise to be heard as well.

The following articles and patents discuss other noise suppression algorithms and systems:

G. Whipple, "Low Residual Noise Speech Enhancement Utilizing Time-Frequency Filtering", Proceedings of the IEEE International Conference on Acoustic Speech Signal Processing, Vol. I, pp. 5–8, 1994; and U.S. Pat. Nos. 5,012,519 and 5,706,395.

SUMMARY OF THE INVENTION

An object of the present invention is to provide a method for suppressing the musical noise. This method is based on linear, spectral subtraction but incorporates a weighted gain smoothing mechanism to suppress the musical noise while minimally affecting speech.

There is therefore provided, in accordance with a preferred embodiment of the present invention, a noise suppressor which includes a signal to noise ration (SNR) determiner, a channel gain determiner, a gain smoother and a multiplier. The SNR determiner determines the SNR per channel of the input signal. The channel gain determiner determines a channel gain $\gamma_{ch}(i)$ per the i-th channel. The gain smoother produces a smoothed gain $\overline{\gamma_{ch}(i,m)}$ per the i-th channel and the multiplier multiplies each channel of the input signal by its associated smoothed gain $\overline{\gamma_{ch}(i,m)}$.

Additionally, in accordance with a preferred embodiment of the present invention, the smoothed gain $\overline{\gamma_{ch}(i,m)}$ is a function of a previous gain value $\overline{\gamma_{ch}(i,m-1)}$ for the i-th channel and a forgetting factor $\alpha$ which is a function of the current level of the SNR for the ith channel.

Additionally, in accordance with a preferred embodiment of the present invention, the forgetting factor a ranges between MAX_ALFA and MIN_ALFA according to the function $$1 - \frac{\sigma(i,m)}{SNR_DR}$$

where $\sigma(i,m)$ is the SNR of the current frame m of the i-th channel and SNR_DR is the allowed dynamic range of the SNR. For example, MAX_ALFA=1.0, MIN_ALFA=0.01 and SNR_DR=30 dB.

Furthermore, in accordance with a preferred embodiment of the present invention, the forgetting factor $\alpha$ is determined by:

$$\alpha = \min\left\{MAX_ALFA, \max\left\{MIN_ALFA, 1 - \frac{\sigma(i,m)}{SNR_DR}\right\}\right\}$$

Additionally, in accordance with a preferred embodiment of the present invention, the smoothed gain $\overline{\gamma_{ch}(i,m)}$ is set to be either the channel gain $\gamma_{ch}(i)$ or a new value, wherein the new value is provided only if the channel gain $\gamma_{ch}(i)$for the current frame m is greater than the smoothed gain $\overline{\gamma_{ch}(i,m-1)}$ for the previous frame m−1.

Additionally, in accordance with a preferred embodiment of the present invention, the smoothed gain $\overline{\gamma_{ch}(im)}$ is defined by:

$$\overline{\gamma_{ch}(i,m)} = \begin{cases} \alpha \cdot \overline{\gamma_{ch}(i,m-1)} + (1-\alpha)\cdot\gamma_{ch}(i,m) & \text{if } \gamma_{ch}(i,m) \geq \overline{\gamma_{ch}(i,m-1)} \\ \gamma_{ch}(i,m) & \text{Otherwise} \end{cases}$$

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
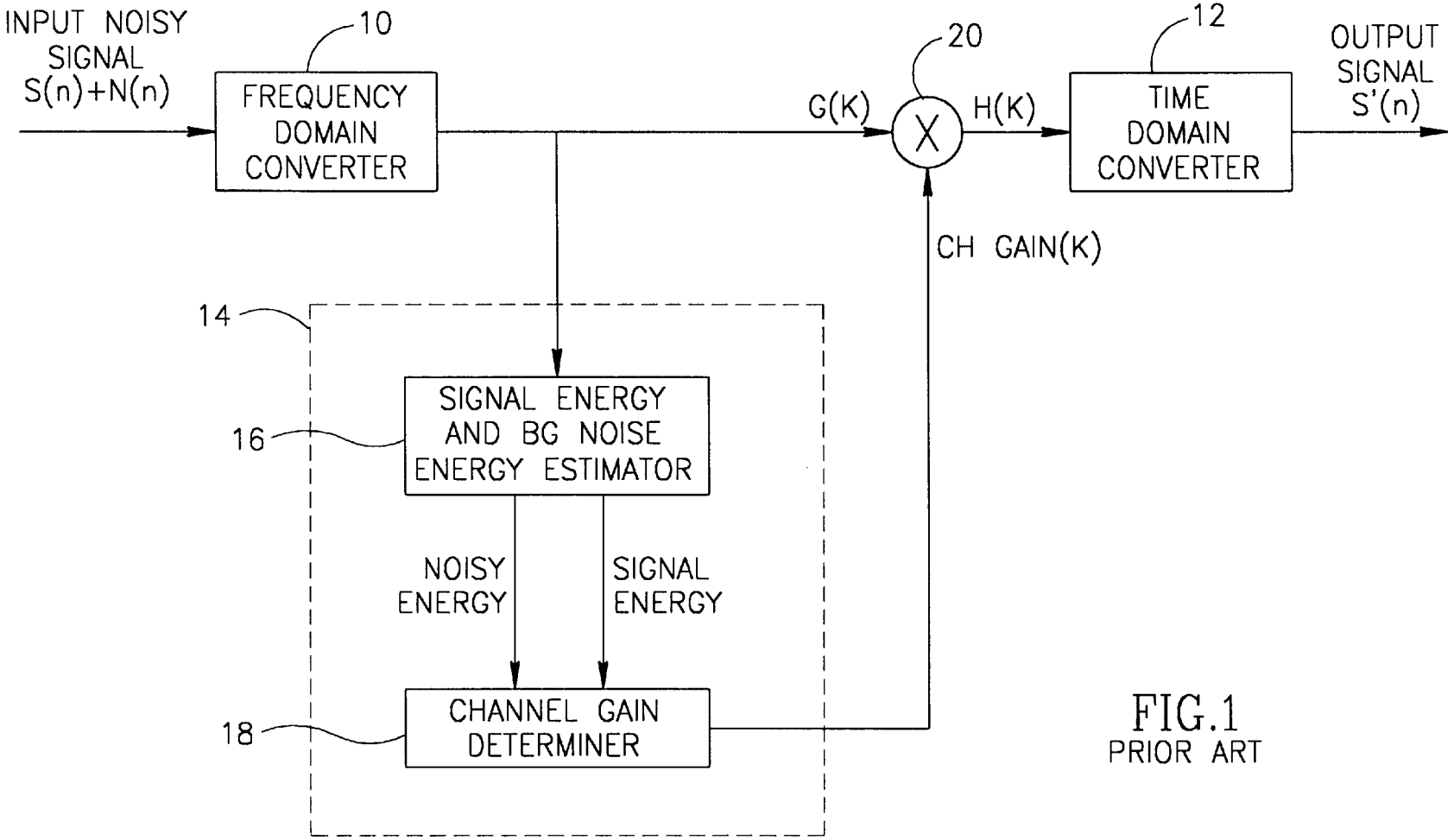
FIG.1 PRIOR ART
FIG. 1 is a schematic illustration of a prior art noise suppressor.
Figure 2:
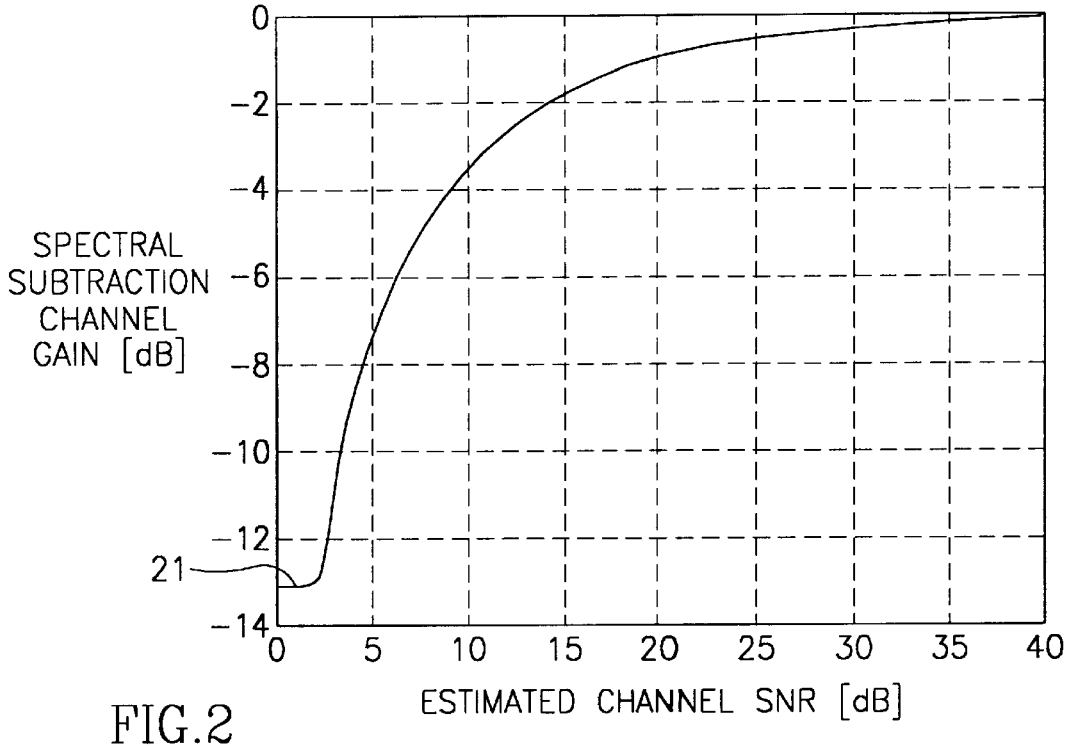
FIG.2 PRIOR ART
FIG. 2 is a graphical illustration of a prior art gain function per signal to noise ratio.
Figure 4:
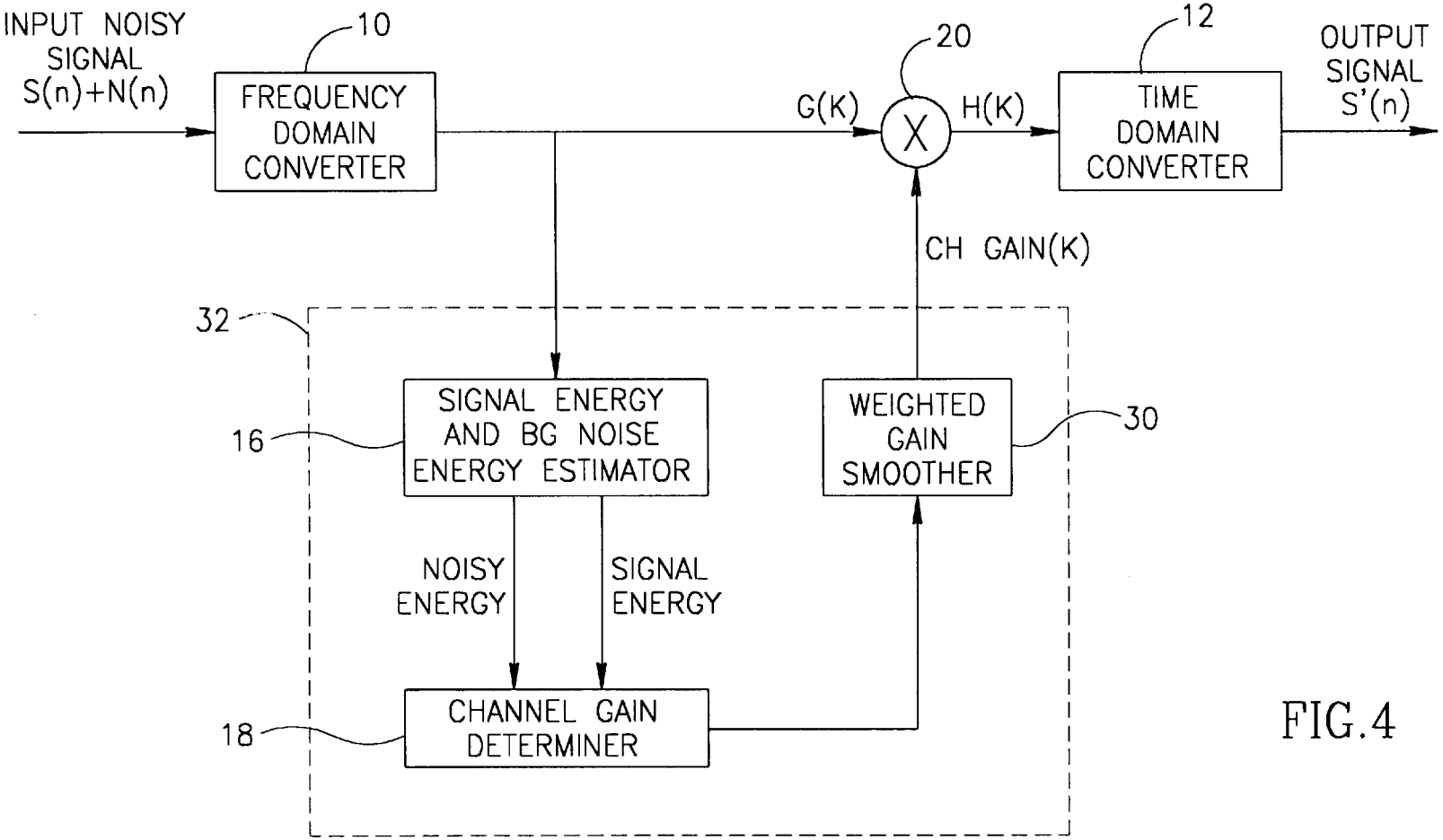
FIG. 4 is a schematic illustration of a noise suppressor having weighted gain smoothing, constructed and operative in accordance with a preferred embodiment of the present invention.

Reference is now made to FIG. 4 which illustrates a noise suppressor having weighted gain smoothing, constructed and operative in accordance with a preferred embodiment of the present invention. The present invention adds a weighted gain smoother 30 to the noise attenuator, now labeled 32, of FIG. 1. Similar reference numerals refer to similar elements.

Weighted gain smoother 30 receives the channel gain $\gamma_{ch}(i)$ produced by the channel gain determiner 18 and smoothes the gain values for each channel. The output of smoother 30, a smoothed gain $\overline{\gamma_{ch}(i,m)}$, for the i-th channel at time frame m, is provided to the multiplier 20.

Applicant has realized that, for signals with low SNR, the channel gain determiner 18 does not properly estimate the channel gain $\gamma_{ch}(i)$ and it is this poor estimation which causes the fluctuations which are the source of the musical noise. The weighted gain smoother 30 of the present invention utilizes previous gain values to smooth the gain function over time. The extent to which the previous gain values are used (a "forgetting factor" $\alpha$) changes as a function of the SNR level.

If the SNR for the channel is low, the forgetting factor a is high to overcome the musical noise. If the SNR for the channel is high, the forgetting factor a is low to enable a rapid update of the channel gain.

The smoothed gain $\overline{\gamma_{ch}(i,m)}$ is set to be either the channel gain $\gamma_{ch}(i)$ produced by the channel gain determiner 18 or a new value. The new value is provided only if the channel gain $\gamma_{ch}(i)$for the current frame m is greater than the smoothed gain $\overline{\gamma_{ch}(m-1)}$ for the previous frame m−1. This is given mathematically in the following equation:

$$\overline{\gamma_{ch}(i,m)} = \begin{cases} \alpha \cdot \overline{\gamma_{ch}(i,m-1)} + (1-\alpha)\cdot\gamma_{ch}(i,m) & \text{if } \gamma_{ch}(i,m) \geq \overline{\gamma_{ch}(i,m-1)} \\ \gamma_{ch}(i,m) & \text{Otherwise} \end{cases}$$

The forgetting factor a is set as a function of the SNR ratio. It ranges between MAX_ALFA and MIN_ALFA according to the function $$1 - \frac{\sigma(i,m)}{SNR_DR},$$

where $\sigma(i,m)$ is the SNR of the current frame m of the i-th channel and SNR_DR is the allowed dynamic range of the SNR. For example, MAX_ALFA=1.0, MIN_ALFA=0.01 and SNR_DR=30 dB.

Specifically, the function is:

$$\alpha = \min\left\{MAX_ALFA, \max\left\{MIN_ALFA, 1 - \frac{\sigma(i,m)}{SNR_DR}\right\}\right\}$$

$$\sigma(i,m) = 20\cdot\log\left(\frac{|E_{ch}(i,m)|}{|E_n(i,m)|}\right)$$

Figure 3A:
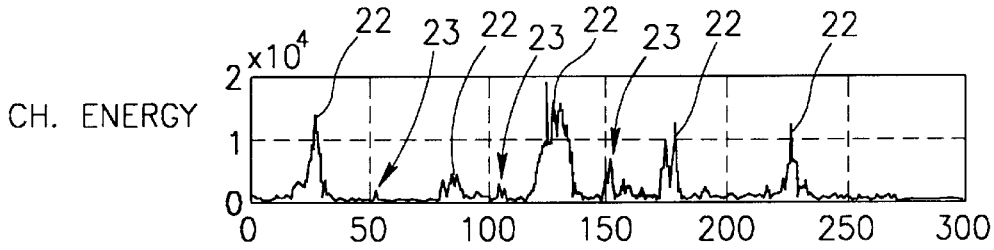
FIG.3A PRIOR ART
FIGS. 3A and 3B are graphical illustrations of a channel energy of an input signal and the associated, prior art, linear spectral subtraction, gain function, over time.
Figure 5A:
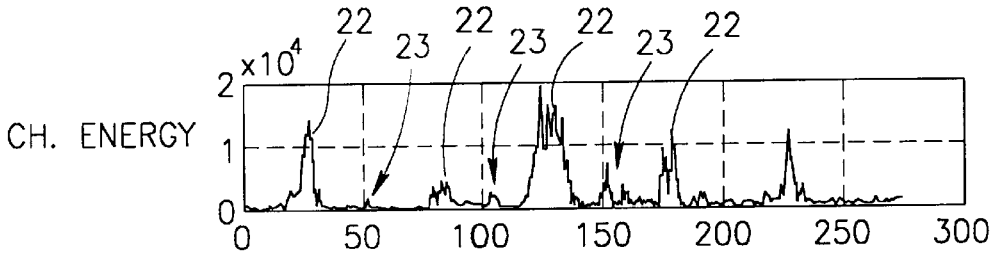
FIG. 5A is a copy of FIG. 3A and is a graphical illustration of the channel energy of an input signal over time.
Figure 5B:
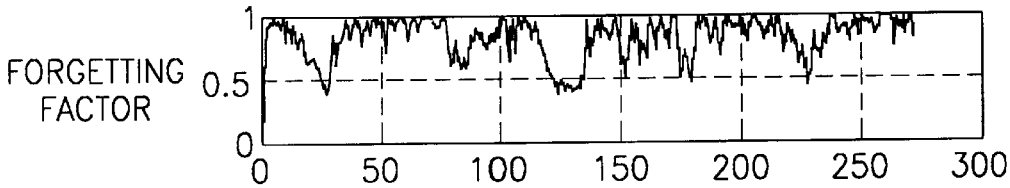
FIGS. 5B and 5C are graphical illustrations of a gain forgetting factor and a smoothed gain function, over time.
Figure 5C:
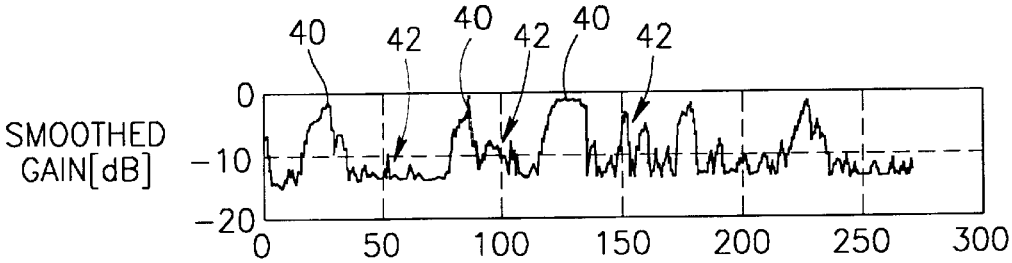

Reference is now made to FIGS. 5A, 5B and 5C which are graphical illustrations over time. FIG. 5A is a copy of FIG. 3A and illustrates the channel energy of an input signal, FIG. 5B illustrates the forgetting factor a for the input signal of FIG. 5A and FIG. 5C illustrates the smoothed gain signal $\overline{\gamma_{ch}(i,m)}$ for the input signal of FIG. 5A.

Figure 3B:
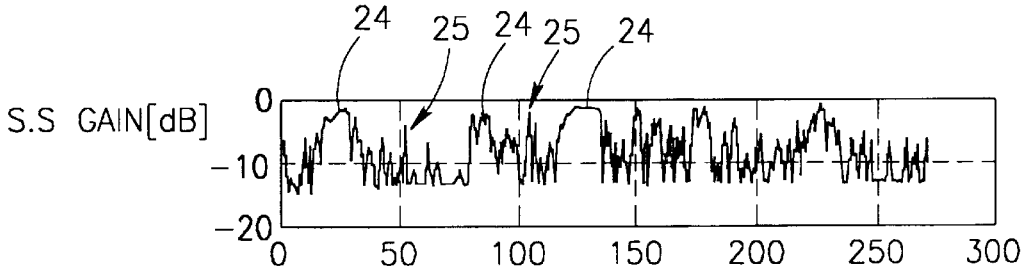
FIG.3B PRIOR ART

By adding the smoother 30 to the output of the gain determiner 18, the gain function becomes a time varying function which is dependent on the behavior of the channel SNR versus time. FIG. 5C shows that the smoothed gain $\overline{\gamma_{ch}(i,m)}$ has accentuated areas 40 between which are areas 42 of low gain activity. The latter are associated with the noise sections 23 (FIG. 5A). Thus, the fluctuations 25 (FIG. 3B) of the prior art gain have been removed. Furthermore, the shape of the accentuated areas 40 have the general shape of the prior art accentuated areas 24 (FIG. 3B). Thus, the musical noise has been reduced (no fluctuations 25) while the quality of the speech (shape of areas 40) has been maintained.

FIG. 5B shows the forgetting factor $\alpha$. It fluctuates considerably during the periods associated with noise sections 23. Thus, forgetting factor a absorbs the fluctuations 25 of the prior art gain.

It will be appreciated by persons skilled in the art that the present invention is not limited by what has been particularly shown and described herein above. Rather the scope of the invention is defined by the claims that follow.

What is claimed is:

1. A noise suppressor for suppressing noise in an input signal, the noise suppressor comprising:

a signal to noise ratio (SNR) determiner for determining the SNR per channel of said input signal;

a channel gain determiner for determining a channel gain $\gamma_{ch}(i)$ per ith channel;

a gain smoother for producing a smoothed gain $\overline{\gamma_{ch}(i,m)}$ for the ith channel; and a multiplier for multiplying each channel of said input signal by its associated smoothed gain $\overline{\gamma_{ch}(i,m)}$, wherein said smoothed gain $\overline{\gamma_{ch}(i,m)}$ is a function of a previous gain value $\overline{\gamma_{ch}(i,m-1)}$ for said ith channel and $\alpha$ forgetting factor a which is a function of the current level of said SNR for said ith channel, and wherein said forgetting factor $\alpha$ ranges between MAX_ALFA and MIN_ALFA according to the function $$1-\frac{\sigma(i,m)}{SNR_DR}$$

where $\sigma(i,m)$ is the SNR of the current frame m of the ith channel and SNR_DR is the allowed dynamic range of the SNR.

2. A noise suppressor according to claim 1 and wherein MAX_ALFA=1.0, MIN_ALFA=0.01 and SNR_DR=30 dB.

3. A noise suppressor according to claim 1 and wherein said forgetting factor $\alpha$ is determined by:

$$\alpha=\min\left\{MAX_ALFA,\ \max\left\{MIN_ALFA,\ 1-\frac{\sigma(i,m)}{SNR_DR}\right\}\right\}.$$

4. A noise suppressor for suppressing noise in an input signal, the noise suppressor comprising:

a signal to noise ratio (SNR) determiner for determining the SNR per channel of said input signal;

a channel gain determiner for determining a channel gain $\gamma_{ch}(i)$ per ith channel;

a gain smoother for producing a smoothed gain $\overline{\gamma_{ch}(i,m)}$ for the ith channel; and a multiplier for multiplying each channel of said input signal by its associated smoothed gain $\overline{\gamma_{ch}(i,m)}$, wherein said smoothed gain $\overline{\gamma_{ch}(i,m)}$ is set to be either the channel gain $\gamma_{ch}(i)$ or a new value, wherein said new value is provided only if the channel gain $\gamma_{ch}(i)$ for the current frame m is greater than the smoothed gain $\overline{\gamma_{ch}(i,m-1)}$ for the previous frame m−1.

5. A noise suppressor according to claim 4 and wherein said smoothed gain $\overline{\gamma_{ch}(i,m)}$ is defined by:

$$\overline{\gamma_{ch}(i,m)}=\begin{cases}\alpha\cdot\overline{\gamma_{ch}(i,m-1)}+(1-\alpha)\cdot\gamma_{ch}(i,m) & \text{if } \gamma_{ch}(i,m)\geq\overline{\gamma_{ch}(i,m-1)}\\ \gamma_{ch}(i,m) & \text{Otherwise}\end{cases}.$$

* * * * *